US008337176B2

(12) United States Patent
Lifson et al.

(10) Patent No.: US 8,337,176 B2
(45) Date of Patent: Dec. 25, 2012

(54) TANDEM COMPRESSORS WITH COMMON INTERMEDIATE PORT

(75) Inventors: Alexander Lifson, Manlius, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 739 days.

(21) Appl. No.: 12/444,758

(22) PCT Filed: Dec. 26, 2006

(86) PCT No.: PCT/US2006/049288

§ 371 (c)(1),
(2), (4) Date: Apr. 8, 2009

(87) PCT Pub. No.: WO2008/079130

PCT Pub. Date: Jul. 3, 2008

(65) Prior Publication Data

US 2010/0051126 A1 Mar. 4, 2010

(51) Int. Cl.
*F04B 23/04* (2006.01)

(52) U.S. Cl. ..... 417/426; 417/286

(58) Field of Classification Search ..... 417/426–429, 417/286

See application file for complete search history.

(56) References Cited

U.S. PATENT DOCUMENTS

| | | | | |
|---|---|---|---|---|
| 4,179,248 | A * | 12/1979 | Shaw | 417/427 |
| 4,383,802 | A * | 5/1983 | Gianni et al. | 417/12 |
| 6,694,750 | B1 | 2/2004 | Lifson et al. | |
| 7,131,285 | B2 | 11/2006 | Lifson et al. | |
| 2002/0164255 | A1 * | 11/2002 | Burr et al. | 417/363 |
| 2005/0150248 | A1 * | 7/2005 | Manole | 62/513 |
| 2005/0160761 | A1 * | 7/2005 | Taras et al. | 62/510 |

OTHER PUBLICATIONS

International Preliminary Report on Patentability mailed May 26, 2011.

Search Report and Written Opinion mailed on Oct. 12, 2007 for PCT/US2006/049288.

* cited by examiner

*Primary Examiner* — Bumsuk Won

(74) *Attorney, Agent, or Firm* — Carlson, Gaskey & Olds, PC

(57) ABSTRACT

A compressor assembly includes at least two tandem compressors. Tandem compressors have at least one common suction manifold, communicating a source of working fluid to be compressed by each of at least two compressors, and at least one common discharge manifold communicating a compressed fluid downstream for further use. A common intermediate pressure manifold communicates with intermediate pressure ports in at least two compressors. The intermediate manifold may communicate fluid to or out of the at least two compressors. There is normally no direct communication between suction and discharge manifolds.

16 Claims, 1 Drawing Sheet

TANDEM COMPRESSORS WITH COMMON INTERMEDIATE PORT

This application is a U.S. National Phase application of PCT Application No. PCT/US2006/049288 filed Dec. 26, 2006.

BACKGROUND OF THE INVENTION

This application relates to tandem compressors that share a common suction manifold and a common discharge manifold. A common intermediate pressure manifold is connected to an intermediate port in each compressor such that a working fluid at some intermediate pressure can be directed to the compression chambers, or taken away from the compression chambers, of both compressors. This application particularly applies to open-cycle systems. In these systems, as compared to closed-cycle systems (such as typical refrigerant systems), an external source supplies working fluid to the compressor suction or intermediate port. The fluid that leaves the discharge port does not return to the suction port (or may come back to the suction port only indirectly, after passing through some other process application). This arrangement would be typical, for example, of natural gas applications, where a natural gas is pumped from a supply tank to be burnt in a number of industrial applications.

Compressors are used in various applications. In some applications, compressors may be utilized to compress air, or to move process gas, such as, for example, a hydrocarbon gas. One technique that is known in the compressor art is the use of "tandem" compressor configurations. Tandem compressor arrangements include at least two compressors that operate in parallel that can be controlled individually or simultaneously. A fluid to be compressed is typically directed through a common suction manifold and then into suction ports associated with each compressor. The compressors independently compress the working fluid and pass it downstream to individual discharge ports, and then typically to a common discharge manifold.

Tandem compressors are operable to deliver compressed gas, and in some cases, various amounts of compressed gas, depending on the demand. As an example, one or more compressors may be taken offline to reduce the amount of gas delivery. Tandem compressors may be of different sizes to provide more flexibility in the amount of gas delivered.

Another technique known in the art is the use of intermediate pressure ports in a compressor. As one example, an intermediate port may receive a fluid at an intermediate (between suction and discharge) pressure to be directed into the compression chambers at an intermediate point in the compression process. This technique can be utilized for cooling the compressor components and lowering a discharge temperature of the compressed working fluid. In other applications, a working fluid may flow from intermediate pressure ports back to the suction line to reduce the amount of the working fluid being compressed by the compressor and delivered to the discharge port. This technique is known as "unloading" of the compressors.

In other designs, an intermediate pressure fluid may be tapped from the intermediate port in the compressor and utilized at any downstream location requiring a compressed gas at a lower pressure than the higher discharge pressure.

While the above applications of having tandem compressors with intermediate ports are known to be utilized for closed-loop refrigerant systems, especially in conjunction with the use of an economized cycle to increase the system capacity and efficiency; the above-described applications of having a combination of intermediate pressure ports and tandem compressors with common manifolds have not been utilized in the open compression cycles, or applications where the compressed discharged fluid doesn't directly return to a suction manifold of the tandem compressors.

SUMMARY OF THE INVENTION

In disclosed embodiments of this invention, at least two compressors operate in tandem, and typically have at least one common suction manifold and one common discharge manifold. A common intermediate pressure manifold communicates with intermediate pressure ports, which in turn communicate with the compression chambers in at least two of the compressors. While the invention is primarily disclosed with two compressors having only one intermediate pressure port, additional compressors having one or more intermediate pressure ports can also be added to tandem compressor configurations. Further, the number of compressors having intermediate pressure ports may be less than an overall number of compressors in a tandem compressor configuration.

In one disclosed embodiment, working fluid is injected through the intermediate pressure ports into the compression chambers at some intermediate pressure (between suction and discharge pressures). This technique can be utilized to compress the fluid from the intermediate pressure to a higher pressure. This technique can also be utilized to cool the internal compressor components and reduce the discharge temperature. For example, water can be injected into the intermediate compressor port to cool the compressed air. The use of the common intermediate pressure manifold reduces the number of connections, simplifies piping, decreases a number of auxiliary system components such as valves, makes control logic less complicated, etc.

A second class of applications utilizes a common intermediate pressure manifold for at least some of tandem compressors, where the gas from the intermediate pressure manifold is returned into the suction line. This technique may be used to reduce the amount of the working fluid being compressed by the compressor and delivered to the discharge port. Again, the benefits of the intermediate common manifold are identical to the advantages outlined above.

In a third example, the intermediate pressure working fluid may be tapped from the intermediate pressure ports and sent to a downstream location that may utilize working fluid at a pressure lower than the higher compressor discharge pressure. Again, the use of the intermediate pressure manifold provides analogous benefits in this class of applications as well.

Tandem compressors that are disclosed in this configuration may be used within an open system, wherein the compressor suction manifold receives a fluid from a source, such as a source of air, or a source of petrochemical gas, etc. In these open-cycle applications, the fluids are compressed and sent to a downstream use. In this class of applications, the compressed fluid is typically not returned to the suction line.

These and other features of the present invention can be best understood from the following specification and drawings, the following of which is a brief description.

DETAILED DESCRIPTION OF THE PREFERRED EMBODIMENTS

Figure 1:
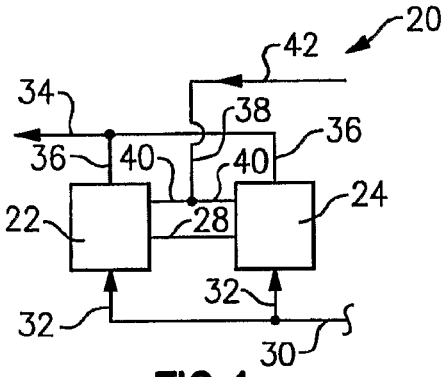
FIG. 1 shows a first class of tandem compressor configurations for a common intermediate pressure manifold

A tandem compressor system 20 including two compressors 22 and 24 is illustrated in FIG. 1. An optional gas equalization line 28 may communicate between the two compressors 22 and 24, as known. A common suction manifold 30 communicates with suction lines 32 leading to each compressor 22 and 24. A common discharge manifold 34 communicates with discharge lines 36 leading from each compressor 22 and 24. The compressor assembly as described to this point is as known in the art. The present invention relates to the use of intermediate pressure lines 40 communicating with intermediate pressure ports leading to each of the compression chambers within the compressors 22 and 24 to pass an intermediate pressure fluid to or from a common intermediate manifold 38 in the arrangement where there is no direct closed-loop communication between the suction and discharge ports. In FIG. 1, a common intermediate manifold 38 communicates with a downstream return line 42, which directs an intermediate pressure fluid into or from the individual lines 40, and then into or from the compression chambers within the compressors 22 and 24. The return line 42 may receive the working fluid from any number of internal or external sources, or deliver the working fluid to any number of internal or external sources. The working fluid can for example be a hydrocarbon gas, air, or any other gas that is required to be compressed. In one example, the injected fluid at an intermediate pressure can come from a gas storage tank. The intermediate fluid can be a fluid that needs to be compressed from an intermediate pressure to discharge pressure or it can be a fluid (such as liquid or gas) that is added to the compression process for cooling purposes, such, as for example, to cool the compressor components and reduce the discharge gas temperature.

Figure 2:
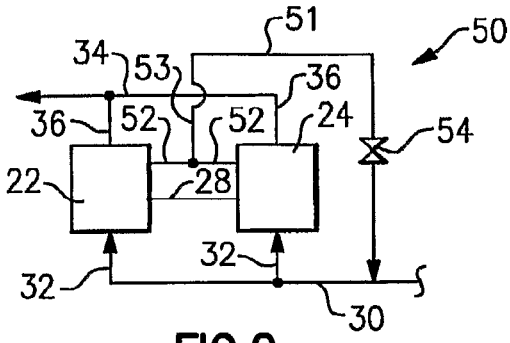
FIG. 2 shows a second class of tandem compressor configurations for a common intermediate pressure manifold.

FIG. 2 shows another embodiment 50, wherein the lines 52 communicating with the intermediate ports in the compressors 22 and 24 also communicate through a common intermediate pressure manifold 53 and with a bypass or unloader line 51. A valve 54 selectively blocks flow of the fluid through the bypass line 51 back to the suction line 30. When the valve 54 is opened, at least a portion of the fluid can pass from the compression chambers in compressors 22 and 24 through the lines 52, into the common intermediate pressure manifold 51, and back to the suction line 30. This technique can be used, for instance, for unloading purposes to tailor working fluid amount supplied by the tandem compressors 22 and 24 to the discharge port to the external demands, while conserving power and improving operating efficiency by recirculation only a partially compressed working fluid. Again in this application, there is no closed loop where the compressor suction and discharge ports are in communication with each other.

Figure 3:
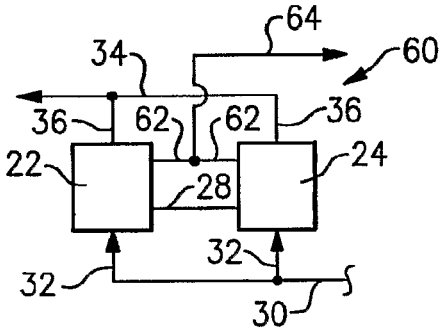
FIG. 3 shows a third class of tandem compressor configurations for a common intermediate pressure manifold.

FIG. 3 shows another tandem compressor assembly 60, wherein the intermediate pressure lines 62 communicate with the common intermediate pressure manifold 64. In this assembly, the fluid is taken away at an intermediate pressure and into the intermediate pressure manifold 64 to be delivered to a downstream location.

Figure 4:
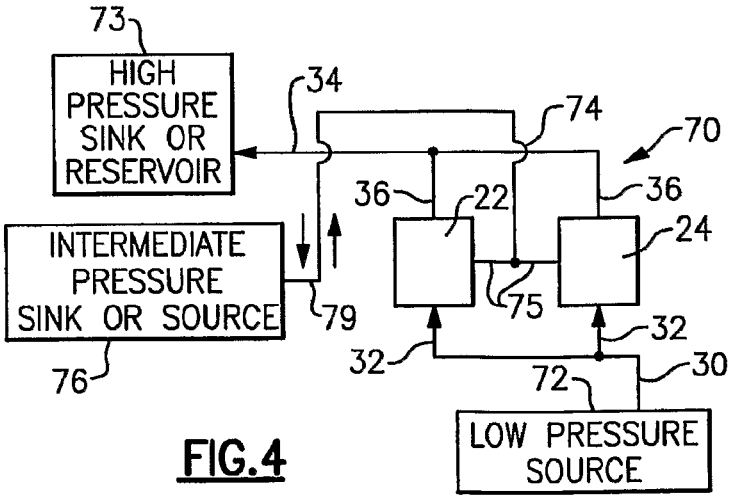
FIG. 4 is an open-cycle system application of common intermediate pressure manifold concept.

FIG. 4 shows an open-cycle system application 70, wherein a fluid to be compressed is taken from a low pressure source 72, delivered into the common suction manifold 30, compressed in the compressors 22 and 24, and then delivered to the common discharge manifold 34. As shown, the common discharge manifold 34 communicates with a downstream high pressure sink or reservoir 73. This could be an open cycle, and the downstream reservoir 73 may not be communicated back to the upstream source 72.

In this application, the intermediate pressure lines 75 communicate with the common intermediate compressor manifold 74. When this open-cycle system is configured for an intermediate pressure fluid intake then the line 79 communicating with the intermediate pressure source 76 may direct an intermediate pressure fluid into the common manifold 74, and into the compression chambers of the compressors 22 and 24. This technique may be utilized for cooling the internal compressor components and the discharge temperature reduction, or for any other purposes, while the intermediate pressure fluid may or may not be the identical to the working fluid.

Alternatively, the common intermediate pressure manifold 74 could communicate with a line 79 leading to a intermediate pressure sink 76, which requires intermediate pressure fluid supply, at a lower pressure than the pressure in the high pressure sink or reservoir 73. Again, the use of the common intermediate pressure manifold 74 allows for the benefits mentioned above. In summary, a technique is shown for communicating an intermediate pressure fluid to or from tandem compressors. The intermediate pressure manifold provides the function of allowing the intermediate pressure fluid to be utilized in combination with the tandem compressors, while reducing the number of connections, simplifying piping, decreasing a number of auxiliary system components such as valves, and making control logic less complicated that would be necessary to provide the adequate functionality for both compressors.

It has to be noted that tandem compressor may be of different sizes and have at least one common discharge manifold and one common suction manifold. Further, there could be several (more than two) compressors connected in tandem, and the number of compressors having a common intermediate pressure manifold could be less than the total number of tandem compressors. A number of intermediate pressure ports can be more than one, and the fluid supplied through these intermediate ports may be identical or different form the working fluid, in the respective applications. Different types of compressors can be used in this application as well. For example, there can be a reciprocating compressor, a rotary compressor, a scroll compressor or a screw compressor.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A tandem compressor assembly comprising:

at least two compressors, having at least one common suction manifold communicating a fluid to be compressed to each of said at least two compressors, and at least one common discharge manifold communicating compressed fluid from each of said at least two compressors to a downstream location;

at least one common intermediate pressure manifold communicating with intermediate pressure ports in each of said at least two compressors;

and said downstream location not communicating all received fluid back to said suction manifold;

wherein said intermediate pressure manifold receives a fluid to be directed into said at least two compressors through said intermediate pressure ports; and wherein at least a portion of said received intermediate pressure fluid is different from the fluid to be compressed communicated through said suction manifold.

2. The tandem compressor assembly as set forth in claim 1, wherein said tandem compressors are of different sizes.

3. The tandem compressor assembly as set forth in claim 1, wherein a number of tandem compressors having said common intermediate pressure manifold is less than the total number of said tandem compressors.

4. The tandem compressor assembly as set forth in claim 1, wherein said intermediate pressure manifold receives a fluid to be directed out of said at least two compressors through said intermediate pressure ports.

5. The tandem compressor assembly as set forth in claim 1, wherein said intermediate pressure manifold directs a partially compressed fluid from compression chambers associated with each of said at least two compressors to a downstream location which utilizes an intermediate lower pressure fluid than the downstream location receiving compressed fluid from said discharge manifold.

6. The tandem compressor assembly as set forth in claim 5, wherein said intermediate pressure manifold returns at least a portion of said partially compressed fluid to said suction manifold, and a valve is placed on a return line to control the return of this portion of the partially compressed fluid.

7. The tandem compressor assembly as set forth in claim 5, wherein said partially compressed fluid is sent to the downstream location, with said downstream location requiring a lower pressure fluid than said downstream discharge pressure location.

8. The tandem compressor assembly as set forth in claim 1, wherein said at least two compressors are part of an open-cycle system, such that none of the fluid received at said downstream location is communicated back to said suction manifold.

9. The tandem compressor assembly as set forth in claim 1, wherein said tandem compressor assembly uses air as said fluid to be compressed.

10. The tandem compressor assembly as set forth in claim 1, wherein said tandem compressor assembly uses hydrocarbon gas as said fluid to be compressed.

11. A tandem compressor assembly comprising;

at least two compressors, having at least one common suction manifold communicating a fluid to be compressed to each of said at least two compressors, and at least one common discharge manifold communicating compressed fluid from each of said at least two compressors to a downstream location;

at least one common intermediate pressure manifold communicating with intermediate pressure ports in each of said at least two compressors;

said downstream location not communicating all received fluid back to said suction manifold;

wherein said intermediate pressure manifold communicates with a. source of a fluid to be compressed, and directs fluid from said source into compression chambers associated with said at least two compressors through said intermediate pressure ports; and, wherein at least a portion of said received intermediate pressure fluid is different from the fluid to be compressed communicated through said suction manifold.

12. A method of operating a tandem compressor assembly comprising the steps of:

providing at least two compressors, having at least one common suction manifold communicating a fluid to be compressed to each of said at least two compressors, and at least one common discharge manifold communicating compressed fluid from each of said at least two compressors to a downstream location;

providing at least one common intermediate pressure manifold communicating with intermediate pressure ports in each of said at least two compressors.

at least some fluid received at said downstream location not being communicated to said suction manifold; and wherein said at least two compressors are part of an open-cycle system, such that none of the fluid received at said downstream location is communicated back to said suction manifold.

13. The method as set forth in claim 12, wherein a number of tandem compressors having said common intermediate pressure manifold is less than the total number of said tandem compressors.

14. The method as set forth in claim 12, wherein said intermediate pressure manifold receives a fluid to be directed into said at least two compressors through said intermediate pressure ports.

15. The method as set forth in claim 14, wherein at least a portion of said received intermediate pressure fluid is different from the fluid to be compressed communicated through said suction manifold.

16. The method as set forth in claim 12, wherein said intermediate pressure manifold receives a fluid to be directed out of said at least two compressors through said intermediate pressure ports.

* * * * *